US005085690A

United States Patent [19]

Ebenhoech et al.

[11] Patent Number: 5,085,690

[45] Date of Patent: Feb. 4, 1992

[54] PREPARATION OF IRON WHISKERS

[75] Inventors: Franz L. Ebenhoech, Ludwigshafen; Reinhold Schlegel, Hassloch, both of Fed. Rep. of Germany

[73] Assignee: BASF Aktiengesellschaft, Ludwigshafen, Fed. Rep. of Germany

[21] Appl. No.: 615,844

[22] Filed: Nov. 20, 1990

[30] Foreign Application Priority Data

Dec. 6, 1989 [DE] Fed. Rep. of Germany ..... 3940347

[51] Int. Cl.[5] ..... C21B 15/04

[52] U.S. Cl. ..... 75/362; 75/413

[58] Field of Search ..... 75/362, 413

[56] References Cited

U.S. PATENT DOCUMENTS

| | | | |
|---|---|---|---|
| 3,694,188 | 9/1972 | Llewelyn | 75/413 |
| 4,056,386 | 11/1977 | McEwan et al. | 75/413 |
| 4,652,305 | 3/1987 | Ebenhoech et al. | 75/362 |
| 4,915,728 | 4/1990 | Schell | 75/362 |

FOREIGN PATENT DOCUMENTS 1224934 3/1967 Fed. Rep. of Germany .

OTHER PUBLICATIONS

Beischer, Abscheidungsformen des Eisens bei der thermischen Zersetzung usw., Bd. 45, Nr. 4, 1939.

*Primary Examiner*—R. Dean
*Assistant Examiner*—George Wyszomierski
*Attorney, Agent, or Firm*—Keil & Weinkauf

[57] ABSTRACT

Iron whiskers are produced by thermal decomposition of iron pentacarbonyl vapor in an indirectly heated empty-space decomposer in which the cross-sectional area for entry of the iron pentacarbonyl into the empty-space decomposer is from 10 to 40% of the cross-sectional area of the empty-space decomposer, the mass flow density of the iron pentacarbonyl vapor, based on the cross-sectional area of the decomposer, is from 0.01 to 0.07 kg per square meter per second, and the temperature in the empty-space decomposer should at no point be below 360° C.

4 Claims, No Drawings

PREPARATION OF IRON WHISKERS

It is known (eg. Elektrochem., 45 (1939), 310–13) that iron carbonyl can be thermally decomposed in the gas phase back into the original components, iron and carbon monoxide. This decomposition, which normally starts at 140° C., may even be initiated at 60° C. by contact with metallic iron. Depending on the conditions under which the decomposition is carried out, the iron is obtained in the form of whiskers or in the form of balls.

The whisker form is obtained at below 700° C. if a large volume of inert gas is present and the products are rapidly removed from the reaction space. By contrast, the ball form is obtained from a high concentration of the carbonyl in the decomposition zone. To produce iron. whiskers it is also known (DE-C-1,224,934) to feed iron carbonyl into an oxygen-free, for example inertized, space in extremely small amounts (ranging in order of magnitude from $10^{-4}$ to $10^{-10}$ mol/cm$^3$ of this space) against a temperature gradient created in this space. The metal atoms set free by the thermal decomposition of carbonyl are ordered by a homogeneous magnetic field into aggregation chains which are parallel to one another and to the force lines of the magnetic field and which are stabilized by said magnetic field.

Although there are potentially interesting applications for iron whiskers, they have hitherto only been used in very small amounts, if at all. The reason for this is their extremely costly manufacture by thermal decomposition, which, whether or not carried out in the presence or absence of a magnetic field, is always carried out in high dilution. Also, the prior art apparatus is only small and enlargement has hitherto not been possible, for example because of the difficulty of producing a homogeneous magnetic field, so that industrial-scale production of iron whiskers has hitherto not been possible.

It is an object of the present invention to provide a process for producing iron whiskers by thermal decomposition of iron pentacarbonyl vapor in an indirectly heated cylindrical empty-space decomposer which is free of the disadvantages of existing processes and in particular produces iron whiskers in high space-time yields.

We have found that this object is achieved when the cross-section at the inlet point of the iron pentacarbonyl into the empty-space decomposer measures from 10 to 40% of the cross-section of the empty-space decomposer and the mass flow density of the iron pentacarbonyl vapor, based on the cross-section of the empty-space decomposer, is from 0.01 to 0.07 kg per square meter per second and when the temperature in the empty-space. decomposer is at no point below 360° C.

The process according to the present invention is founded on the surprising discovery that the rate of formation of iron whiskers by the thermal decomposition of iron pentacarbonyl is independent of the degree of dilution of the iron pentacarbonyl if the conditions stipulated by the present invention are observed. It is essential, on the one hand, that the iron pentacarbonyl vapor flows into the empty-space decomposer at a low speed. This requirement is met when the cross-section of the point of entry into the empty-space decomposer is made relatively large so that it accounts for 10–40%, preferably 15–30%, of the cross-section of the cylindrical empty-space decomposer. Together with the feature that the mass flow density of the carbonyl vapor (based on the amount of carbonyl introduced into the empty-space decomposer) should be from 0.01 to 0.07 kg of $Fe(CO)_5/m^2$.sec, the combined effect is to produce within the empty-space decomposer a uniform plug flow in the direction of the outlet at the other end and to suppress any backflow of gas through formation of a gas cycle within the reactor. According to a further feature of the process according to the present invention, the temperature in the empty-space decomposer should not be below 360° C. at any point. This has the effect of producing a uniform rate of decomposition of the carbonyl across the entire cross-section. This again aids the formation of uniform plug flow and prevents a recirculating gas flow within the decomposer. This is because, in conventionally operated decomposers, a large temperature difference becomes established between the edge zones and the central zones in that a relatively cold zone forms at the center, where the carbonyl is only partially decomposed, whereas decomposition of the carbonyl is substantially complete in the edge zone. In consequence, the relatively heavy carbonyl vapor descends in the center, while the lightweight carbon monoxide formed in the course of the decomposition flows upward, and becomes hotter and hotter, in the edge zones. The resulting recirculating gas flow also causes recirculation of previously formed iron seed particles, which form sites for the decomposition of further carbonyl and for the accretion, in onion skin form, of further iron formed by said decomposition.

To supplement a uniform temperature profile, the carbonyl vapor may be admixed, before entry into the empty-space decomposer, with oxygen, for example in the form of air, which will undergo an exothermic reaction with the iron carbonyl. Per mole of iron carbonyl it is possible to add from 0.03 to 0.2 mol of oxygen. It is also possible to add ammonia to the carbonyl in a conventional manner in an amount of from 0.2 to 0.8 mol per mole of iron pentacarbonyl.

The process according to the present invention brings about the formation of many uniform seeds and at the same time prevents these seeds from growing through accretion. Owing to the lack of backflow, these seeds combine to form filiform or whiskery structures.

The process according to the present invention, compared with existing processes for producing iron whiskers, has the advantage that it can be carried out in large apparatus without using a magnetic field. The apparatus can be made of steel rather than a costly nonmagnetic material. There is a further advantage in that there are no large quantities of inert gas to be heated up and cooled down again unnecessarily. The iron whiskers are deposited from virtually undiluted carbon monoxide, which may be reused for forming further iron carbonyl.

The Examples which follow are carried out using a cylindrical empty-space decomposer 1.0 m in diameter, which accordingly has a cross-sectional area of 0.785 m$^2$ The empty-space decomposer is 6.4 m in length and is covered along a length of 6 m (starting 0.4 m below the inlet pipe at the upper end) with a heating shell. This heating shell, which is made up of 3 compartments, is heated with hot combustion gases to 440°–550° C.

The internal temperatures of the empty-space decomposer are measured in 3 horizontal planes at distances of 0.1 m and 0.5 m from the hot wall.

EXAMPLE 1 (COMPARATIVE EXAMPLE)

The inlet pipe for the iron pentacarbonyl vapor is 0.3 m in diameter and thus has a cross-sectional area of 0.071 $m^2$, corresponding to 9% of the cross-sectional area of the empty-space decomposer. Iron pentacarbonyl vapor is introduced into the empty-space decomposer at a rate of 87 kg/h, corresponding to a mass flow density of 0.031 $kg/m^2$.sec. At the same time ammonia is passed in at a rate of 6 standard $m^3/h$. The temperature in the heating gas shell is 480°-520° C. The empty-space decomposer is found to have the following internal temperatures:

| | 0.1 m away from the wall | 0.5 m away from the wall |
|---|---|---|
| Top plane | 360° C. | 330° C. |
| Middle plane | 370° C. | 340° C. |
| Bottom plane | 420° C. | 380° C. |

About 26 kg/h are obtained of a product containing iron whiskers and iron balls. The diameter of the whiskers is about 0.5 μm and their length is >50 μm. The size of the balls is <3 μm. The BET specific surface area is 0.6 $m^2/g$. The product contains about 2.5% by weight of carbon, and about 2.5% by weight of nitrogen and about 2% by weight of oxygen.

EXAMPLE 2

The inlet pipe for the iron pentacarbonyl vapor is 0.4 m in diameter and thus has a cross-sectional area of 0.13 $m^2$, corresponding to 16% of the cross-sectional area of the empty-space decomposer. As in Example 1, iron pentacarbonyl vapor and ammonia are introduced at respective rates of 87 kg/h and 6 standard $m^3/h$. The temperature in the heating gas shell is 480°-520° C. The empty-space decomposer is found to have the following internal temperatures:

| | 0.1 m away from the wall | 0.5 m away from the wall |
|---|---|---|
| Top plane | 400° C. | 360° C. |
| Middle plane | 420° C. | 380° C. |
| Bottom plane | 440° C. | 400° C. |

About 27 kg/h are obtained of a product consisting of iron whiskers alone. The whisker diameter is about 0.4 μm and the length is >50 μm. There is no preferred direction, the whiskers being in a random arrangement. The BET specific surface area is 3 $m^2/g$. The whiskers contain about 4% by weight of carbon, about 3% by weight of nitrogen and about 3% by weight of oxygen.

EXAMPLE 3

The inlet pipe for the iron pentacarbonyl vapor is 0.5 m in diameter and thus has a cross-sectional area of 0.196 $m^2$, corresponding to 25% of the cross-sectional area of the empty-space decomposer. Iron pentacarbonyl vapor is introduced into the empty-space decomposer at a rate of 117 kg/h, corresponding to a mass flow density of 0.041 $kg/m^2$.sec. At the same time ammonia is introduced at a rate of 8 standard $m^3/h$. The temperature in the heating gas shell is 520°-560° C. The empty-space decomposer is found to have the following internal temperatures:

| | 0.1 m away from the wall | 0.5 m away from the wall |
|---|---|---|
| Top plane | 440° C. | 400° C. |
| Middle plane | 440° C. | 400° C. |
| Bottom plane | 430° C. | 390° C. |

The product comprises iron whiskers obtained at a rate of 31 kg/h. The whiskers have a diameter of about 0.25 μm and a length of >50 μm, and they are in a random arrangement. The BET surface area is about 4 $m^2/g$. The whiskers contain about 5% by weight of carbon, about 3% by weight of nitrogen and about 3% by weight of oxygen.

EXAMPLE 4

Example 3 is repeated, except that air is added to the iron pentacarbonyl vapor at a rate of 2.5 standard $m^3/h$ at a point upstream of the inlet pipe into the empty-space decomposer. The temperatures in the empty-space decomposer are raised by about 10° C. in the upper plane.

This gives about 33 kg of iron whiskers per hour. The whiskers have a diameter of about 0.2 μm and a length of >50 μm. The BET surface area is about 5 $m^2/g$. The whiskers contain about 6% by weight of carbon, about 4% by weight of nitrogen and 5% by weight of oxygen.

We claim:

1. A process for producing iron whiskers by the thermal decomposition of iron pentacarbonyl vapor in an indirectly heated cylindrical empty-space decomposer which comprises: passing the ron pentacarbonyl vapor into the empty-space decomposer at an inlet point having a cross-section which measures from 10 to 40% of the cross-section of the empty-space decomposer, maintaining the mass flow density of the iron pentacarbonyl vapor, based on the cross-section of the empty-space decomposer, at from 0.01 to 0.07 kg per square meter per second, and the temperature in the empty-space decomposer being at no point below 360° C.

2. The process of claim 1, wherein the cross-section of the inlet point measures from 15 to 30% of the cross-section of the empty-space decomposer.

3. The process of claim 1, wherein before entry into the empty-space decomposer the iron pentacarbonyl is admixed with oxygen or an oxygen-containing gas in an amount of from 0.03 to 0.2 mol of oxygen per mole of iron pentacarbonyl.

4. The process of claim 1, wherein ammonia is introduced into the empty-space decomposer together with the iron pentacarbonyl in an amount of from 0.2 mol to 0.8 mol of $NH_3$ per mole of iron carbonyl.

* * * * *

UNITED STATES PATENT AND TRADEMARK OFFICE

CERTIFICATE OF CORRECTION

PATENT NO. : 5,085,690

DATED : Feb. 4, 1992

INVENTOR(S) : Franz Ebenhoech

It is certified that error appears in the above-identified patent and that said Letters Patent is hereby corrected as shown below:

Claim 1, column 4, line 39

"ron" should read --iron--

Signed and Sealed this

Thirteenth Day of April, 1993

*Attest:*

STEPHEN G. KUNIN

*Attesting Officer*

*Acting Commissioner of Patents and Trademarks*